US007819045B2

(12) United States Patent
Chang

(10) Patent No.: US 7,819,045 B2
(45) Date of Patent: Oct. 26, 2010

(54) HOLE PUNCH STRUCTURE

(76) Inventor: Chun-Yuan Chang, P.O. Box 44-2049, Taipei (TW) 10668

( * ) Notice: Subject to any disclaimer, the term of this patent is extended or adjusted under 35 U.S.C. 154(b) by 499 days.

(21) Appl. No.: 11/892,314

(22) Filed: Aug. 22, 2007

(65) Prior Publication Data

US 2009/0049967 A1 Feb. 26, 2009

(51) Int. Cl.
*B26F 1/02* (2006.01)

(52) U.S. Cl. ..... 83/633; 83/167; 83/638; 83/588

(58) Field of Classification Search ..... 83/618, 83/638, 167, 684, 549, 620, 624, 625, 626, 83/627, 628, 630, 633, 588, 597, 513, 691, 83/687, 635
See application file for complete search history.

(56) References Cited

U.S. PATENT DOCUMENTS

| | | | | |
|---|---|---|---|---|
| 1,601,414 | A * | 9/1926 | Purple | 83/563 |
| 4,166,404 | A * | 9/1979 | Almog | 83/167 |
| 6,032,566 | A * | 3/2000 | Evans et al. | 83/618 |
| 6,688,199 | B2 * | 2/2004 | Godston et al. | 83/167 |
| 7,469,622 | B2 * | 12/2008 | Nishimura et al. | 83/638 |
| 2003/0010176 | A1 * | 1/2003 | Chiang | 83/618 |
| 2007/0227286 | A1 * | 10/2007 | Kandasamy | 74/469 |
| 2007/0266836 | A1 * | 11/2007 | Marks | 83/684 |
| 2008/0314219 | A1 * | 12/2008 | Liu | 83/618 |
| 2009/0151532 | A1 * | 6/2009 | Liu | 83/618 |
| 2009/0223341 | A1 * | 9/2009 | Huang | 83/588 |

FOREIGN PATENT DOCUMENTS

EP 0353389 * 7/1990

* cited by examiner

*Primary Examiner*—Laura M. Lee
(74) *Attorney, Agent, or Firm*—Banger Shia

(57) ABSTRACT

The invention provides a hole punch structure. More particularly, one end of an exposed longitudinal handle is moved together with a slide rod in a hole-punching mechanism covered by a casing. Thus, when the other end of the handle is pressed down, the slide rod is also moved transversely, a push rod connected to the slide rod is also moved, and a tool shelf is pressed vertically downward to achieve a hole-punching operation of a punching post. This hole punch structure works according to the principle of lever of the longitudinal handle.

3 Claims, 6 Drawing Sheets

HOLE PUNCH STRUCTURE

The invention relates to a hole punch structure, in which a handle is pushed to move a slide rod to move transversely according to the principle of leverage. In addition, a push rod moves a tool shelf vertically downward according to the combination relationship between the slide rod and the push rod so that the laborsaving hole-punching operation can be finished.

DESCRIPTION OF THE PRIOR ART

FIG. 6 is a schematic illustration showing a conventional hole punch structure. As shown in FIG. 6, the typical hole punch structure is mainly composed of a pressing plate (81), a base (82), a spring (83) and a punching post (84). Pressing the pressing plate (81) can make the punching post (84) penetrate through an accommodating hole (85) so that the resilience of the spring (83) makes the pressing plate (81) recover to an original position and the hole-punching operation can be finished.

However, this kind of hole punch structure is poorly designed and thus tends to hurt the users because the hole punch structure is not completely covered. If the user improperly uses this hole punch structure, he or she may be easily hurt by the exposed tool. In addition, the spring for recovering the pressing plate is also exposed outside, and thus tends to oxidize due to the humid climate. Thus, the conventional hole punch structure cannot satisfy the economic effectiveness and the utility, and cannot be regarded as a good one.

Furthermore, in the aspect of the mechanism of the typical hole punch, the user directly presses down the pressing plate to move the tool down. Actually, the hole punch cannot be used in a more laborsaving manner, and pressing the hole punch tends to make the wrist of the user have an ache. So, the user cannot use the hole punch continuously for a long period of time.

SUMMARY OF THE INVENTION

In view of the associated problems induced by the design defects of the conventional hole punch structure, the present inventor has paid attention to the research and development according to the experience and the technology in manufacturing the associated products for many years, and thus developed this hole punch structure. The main object thereof is to design the mechanism by arranging a handle, a slide rod, a push rod, a tool shelf and a base and thus to achieve the laborsaving hole-punching operation. Furthermore, the special structures in the components can effectively prevent the tool from moving down so that the hole-punching operation of the punching post can be performed more precisely and smoothly.

Another object of the invention is to provide a casing to cover the hole punch for the purpose of preventing the internal components and the internal mechanism from being exposed outside and preventing the exposed tool from hurting the user. Also, it is possible to protect the internal mechanism of the hole punch structure from collision or damage so that the durability and the utility thereof can be enhanced.

The invention achieves the above-identified objects by providing a hole punch structure including a casing and a bottom cover connected to the casing to achieve the overall covering effect. In addition, one end of a longitudinal handle exposed from the casing is moved together with a slide rod. When the other end of the handle is pressed down, it can push the slide rod to move transversely and move a push rod connected to the slide rod. Meanwhile, a tool shelf is pressed vertically downward so that the object of punching the hole by a punching post is achieved. Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The structure, technological means and effects of the invention will be described with reference to the preferred embodiment in conjunction with the accompanying drawings.

Figure 1:
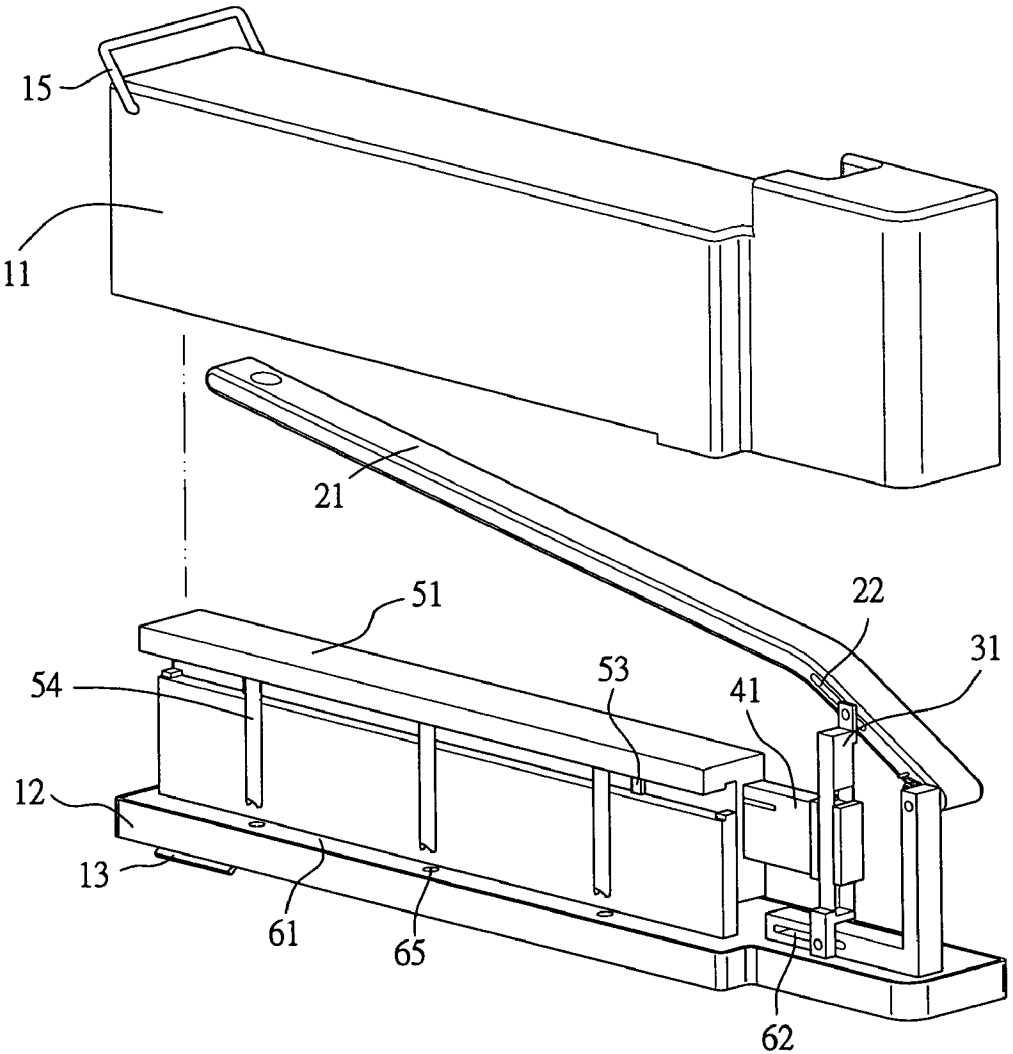
FIG. 1 is a schematic illustration showing a hole punch structure according to the invention.

FIG. 1 is a schematic illustration showing a hole punch structure according to the invention. As shown in FIG. 1, the hole punch structure of the invention is mainly composed of a casing (11), a bottom cover (12), a handle (21), a slide rod (31), a push rod (41), a tool shelf (51) and a base (61). After the internal mechanism has been assembled, the overall mechanism is placed on the bottom cover (12), and then the casing (11) is mounted to cover the mechanism and thus to protect the internal mechanism and parts of the hole punch structure.

Figure 2:
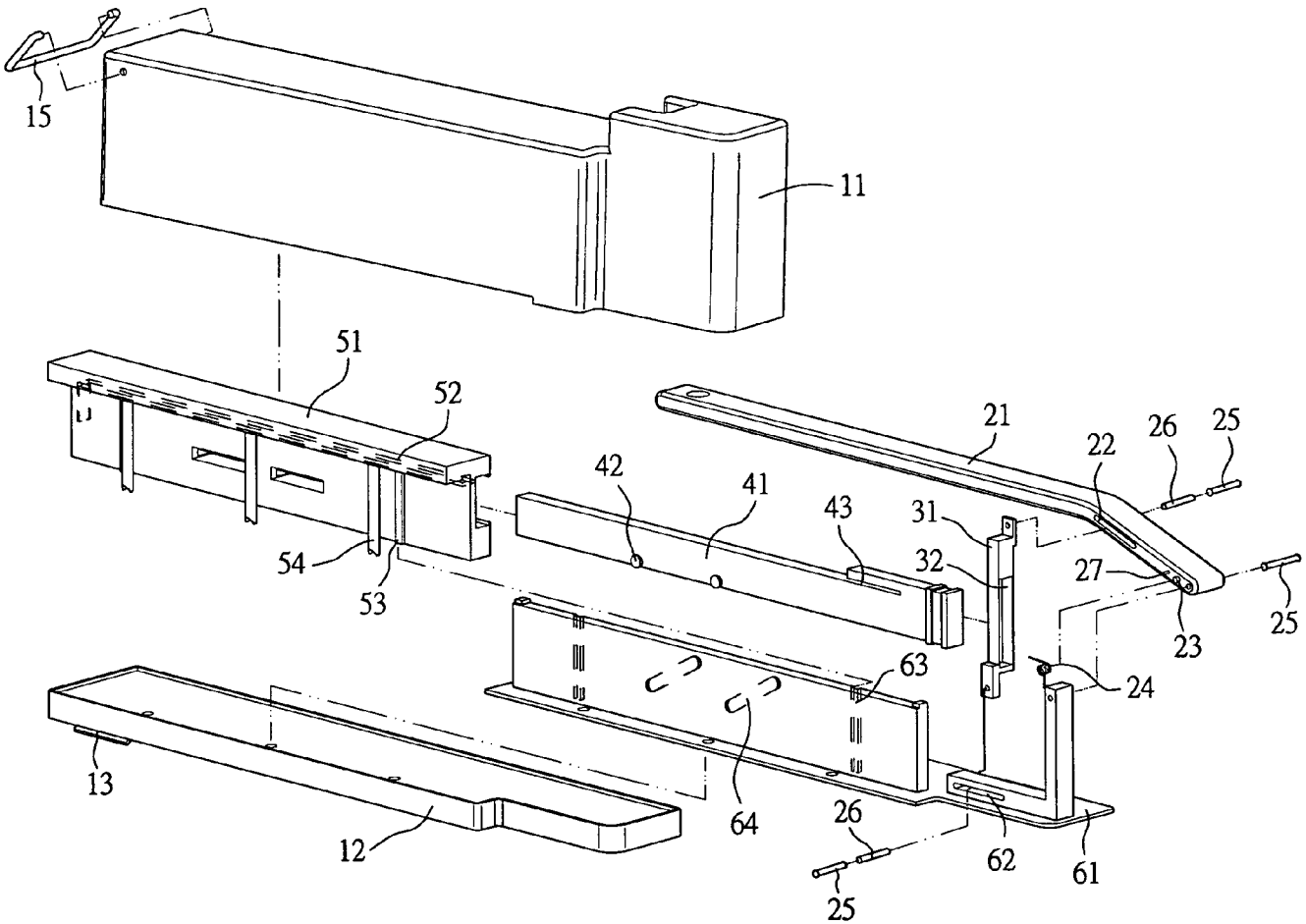
FIG. 2 is a schematically exploded view showing the hole punch structure according to the invention.

FIG. 2 is a schematically exploded view showing the hole punch structure according to the invention. As shown in FIG. 2, one end of the handle (21) is combined with the base (61) though a shaft (25). A second shaft (25) is fitted with a rotatable shaft (26), the combination of the shaft (25) and the rotatable shaft (26) is moved back and forth along the displacement groove (22) and thus moves the slide rod (31) transversely. A third shaft (25) passes through a bottom portion of the slide rod and is connected to a displacement groove (62) of the base (61). The first (25) and third (25) shafts are also fit with a rotatable shaft (26). Furthermore, a torsional spring (24) is fit with a mounting projection (23) on the lateral side of the handle (21), and has one end pressing against a pressing rod (27). When the handle (21) is pressed down, an elastic recovering force is provided so that the handle (21) can move back to the original position easily. Also, the slide rod (31) is tightly fit with the push rod (41) through an engaging slot (32). The push rod (41) and the tool shelf (51) are engaged, coupled, or connected together by fitting a slit (43) formed in the push rod (41) with an engaging slot (52) of the tool shelf (51). The push rod (41) and the base (61) are engaged, coupled, or connected together by fitting a plurality of circular projections (42) on the push rod (41) each with a corresponding restricting slot (64) on the base (61). In addition, the tool shelf (51) and the base (61) are engaged, coupled, or connected together by fitting rectangular projections (53) on the tool shelf (51) with corresponding rectangular shots (63) of the base (61). Finally, the push rod (41) and the base (61) having the restricting and aligning effects to make the tool shelf (51) achieve the vertically downward pressing effect.

Figure 3:
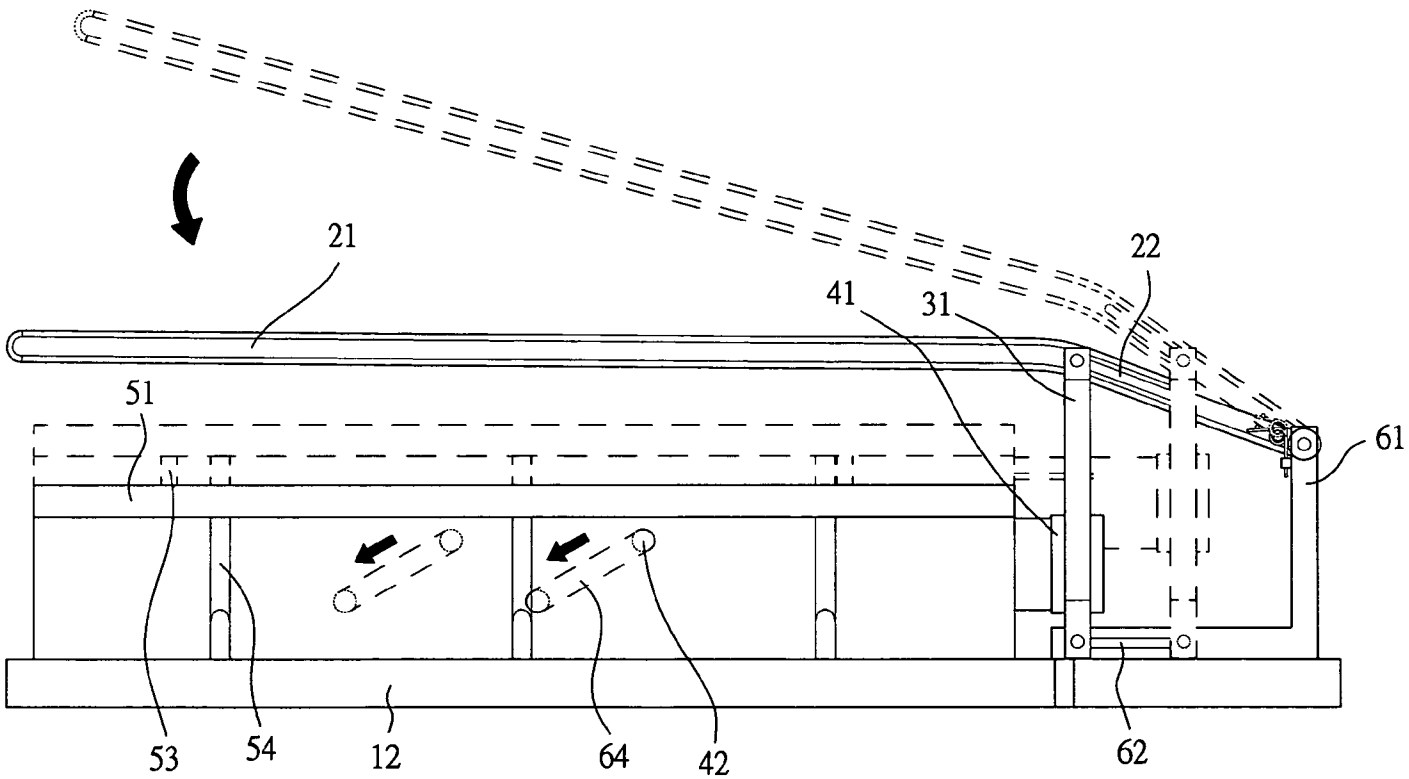
FIG. 3 is a schematic illustration showing operations of the invention.

FIG. 3 is a schematic illustration showing operations of the invention. When the handle is not used, one end of the handle rises to keep a predetermined distance from and an angle with the casing. The handle (21) being pressed down also moves the push rod (41) transversely. Also, a punching post or punching posts (54) can penetrate through an accommodating hole or accommodating holes (65) to finish the punching operation when the push rod (41) moves the tool shelf (51) vertically downward due to the combination relationship between the slide rod (31) and the push rod (41).

Figure 4:
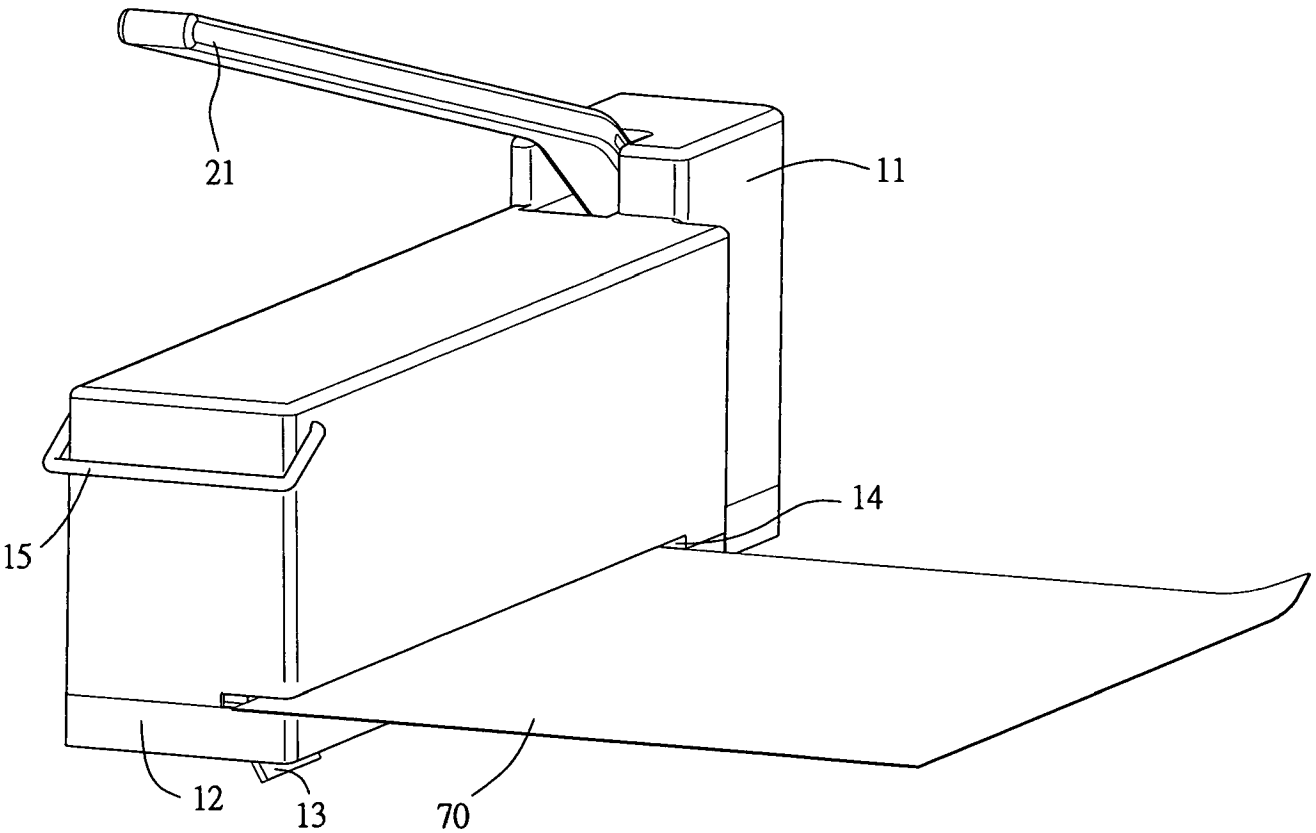
FIG. 4 is a first schematic illustration showing the embodiment of the invention.

FIG. 4 is a first schematic illustration showing the embodiment of the invention. Furthermore, as shown in FIG. 4, the clearance in a gap (14) between the casing (11) and the bottom cover (12) may accommodate several sheets (70). When the sheets are inserted into the gap (14), the sheets can be correctly aligned with the accommodating hole (65) by pressing the sheets against the cutting edge of the casing (11). In addition, the gap (14) of the casing (11) is designed to effectively align the accommodating hole (65) with the sheets (70) without any other pressing or engaging mechanism. In addition, paper flakes after the sheets are punched fall into the chamber of the bottom cover (12). Thus, the paper flakes in the bottom cover (12) are removed after a paper flake cover (13) is opened, and the overall utility and convenience can be significantly enhanced.

Figure 5:
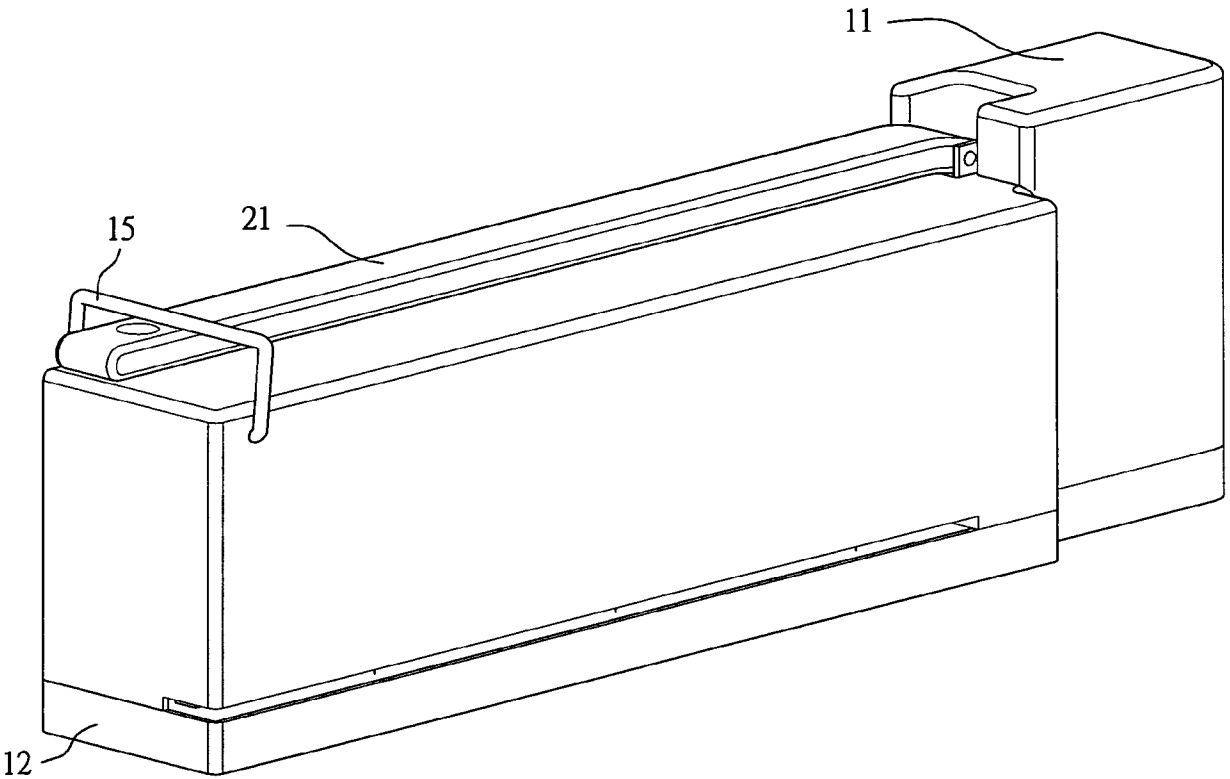
FIG. 5 is a second schematic illustration showing the embodiment of the invention.
Figure 6:
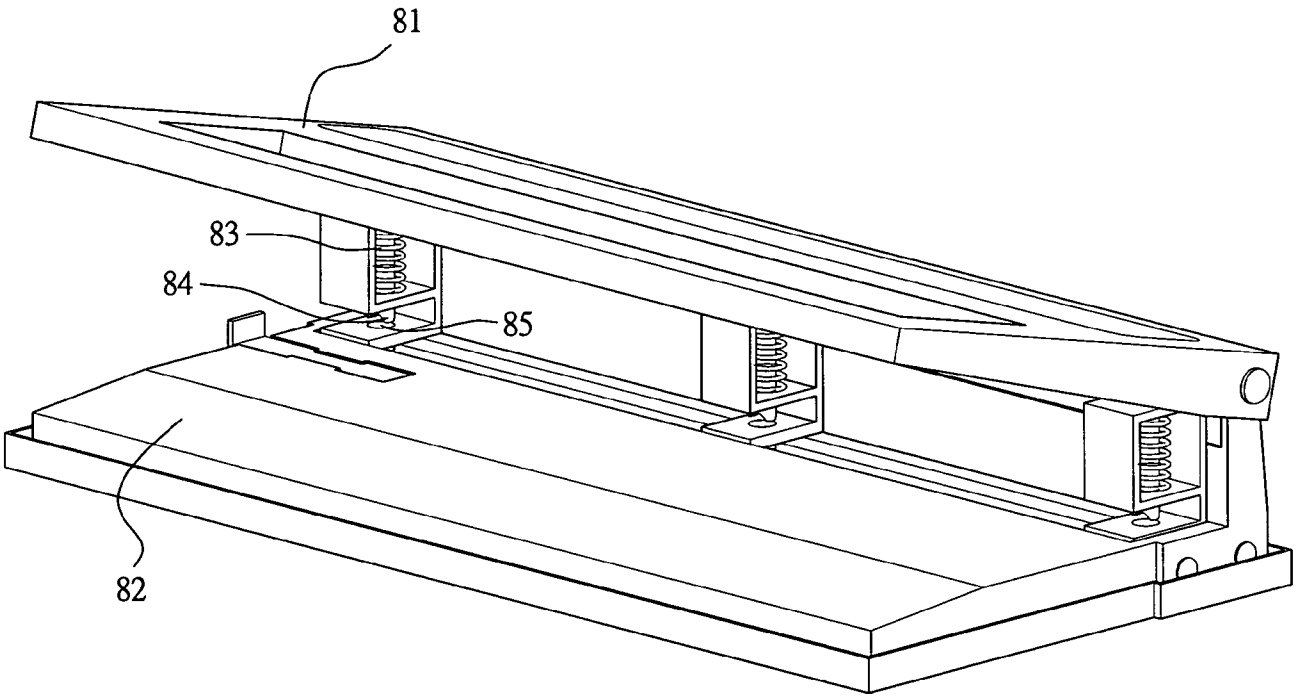
F I G. 6 (PRIOR ART)
FIG. 6 is a schematic illustration showing a conventional hole punch structure.

FIG. 5 is a second schematic illustration showing the embodiment of the invention. As shown in FIG. 5, the casing (11) has a loop (15). When the hole punch is not used, the handle (21) is pressed to the position where the handle (21) is parallel to the casing (11), and the loop (15) locks the handle (21). The provision of the loop (15) can effectively reduce the space for package, reduce the material waste, facilitate the storage, and reduce the waste in the storage space. Thus, the economic value and utility thereof can be greatly enhanced.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A hole punch structure, comprising: a casing, a bottom cover, a paper flake cover, a longitudinal handle, a slide rod, a push rod, a tool shelf and a base, wherein the casing has a top portion having a space for the handle to be pressed into and out of the space, and has one end on which a loop for locking the handle is mounted; the bottom cover is disposed under the casing and is formed with a plurality of accommodating holes; the paper flake cover is mounted onto a bottom portion of the bottom cover; the handle has one end, which rises when the handle is not used, another end connected to the base through a shaft, and a lateral side formed with a displacement groove; a second shaft passes through a top portion of the slide rod and is combined with the handle through the displacement groove; the slide rod has a lateral side formed with an engaging slot, the push rod and the slide rod are engaged, coupled, or connected together through the engaging slot, and a third shaft passes through a bottom portion of the slide rod and is connected to a displacement groove of the base; the push rod has a top portion formed with a slit, through which an engaging slot of the tool shelf is pushed to move the tool shelf vertically downward, and the push rod has a lateral side formed with a plurality of circular projections, each circular projection moves back and forth in a respective restricting slot of the base; the tool shelf has a lateral side on which a plurality of punching posts and a plurality of vertical rectangular projections are disposed, the rectangular projections of the tool shelf are each connected to a respective rectangular slot of the base, the tool shelf further has another lateral side formed with a chamber, the push rod is disposed in the chamber, the base is disposed above the bottom cover and is formed with a plurality of accommodating holes, the coupling of the rectangular projections and the rectangular slots and the coupling of the circular projections and the restricting slots also provides a restricting and aligning effect to move the tool shelf vertically downward; and when one end of the handle is pressed, the slide rod is pushed to move transversely according to connections between the shafts, the handle, and the base so that the push rod connected to the slide rod is moved, and the slit of the push rod pushes the engaging slot of the tool shelf so that the tool shelf is pressed vertically downward to achieve an effect of punching holes in a workpiece when the punching posts pass through the accommodating holes.

2. The hole punch structure according to claim 1, wherein a mounting projection and a pressing rod are disposed on the lateral side of the handle, and a torsional spring is mounted on the mounting projection with one end tightly pressing against the pressing rod.

3. The hole punch structure according to claim 1, wherein a wear-resistant rotatable shaft is fit with each shaft to make the slide rod slide more smoothly.

* * * * *